US005520369A

United States Patent [19]

Chatard

[11] Patent Number: 5,520,369

[45] Date of Patent: May 28, 1996

[54] METHOD AND DEVICE FOR WITHDRAWING AN ELEMENT FASTENED TO A MOBILE INSTALLATION FROM THE INFLUENCE OF THE MOVEMENTS OF THIS INSTALLATION

[75] Inventor: Michel Chatard, Rueil Maimaison, France

[73] Assignee: Institut Francais du Petrole, Rueil Malmaison, France

[21] Appl. No.: 854,395

[22] Filed: Mar. 19, 1992

Related U.S. Application Data

[63] Continuation of Ser. No. 559,073, Jul. 30, 1990, abandoned, which is a continuation-in-part of Ser. No. 814,758, Dec. 30, 1985, abandoned.

[30] Foreign Application Priority Data

Dec. 28, 1984 [FR] France ..... 84 19965

[51] Int. Cl.[6] ..... B66D 1/00

[52] U.S. Cl. ..... 254/277; 254/900

[58] Field of Search ..... 254/277, 900, 254/336

[56] References Cited

U.S. PATENT DOCUMENTS

| | | | |
|---|---|---|---|
| 3,743,249 | 7/1973 | van Daalen | 254/277 |
| 3,788,073 | 1/1974 | Castela | 254/900 |
| 3,788,074 | 1/1974 | Castela | 254/900 |
| 3,791,628 | 2/1974 | Burns et al. | 254/277 |
| 3,912,227 | 10/1975 | Meeker et al. | 254/900 |
| 4,155,538 | 5/1979 | Claasen | 254/277 |
| 4,421,173 | 12/1983 | Beakley et al. | 254/277 |
| 4,470,355 | 9/1984 | Kunczynski | 254/277 |
| 4,552,339 | 11/1985 | Werners et al. | 254/277 |

*Primary Examiner*—Katherine Matecki

*Attorney, Agent, or Firm*—Antonelli, Terry, Stout & Kraus

[57] ABSTRACT

A method and device for withdrawing an element fastened to a mobile installation from the influence of the movements of this installation. The device comprises at least one actuating cylinder, at least one accumulator and several pulleys, are determined so that the mechanical and hydro-pneumatic forces are substantially equal.

21 Claims, 6 Drawing Sheets

METHOD AND DEVICE FOR WITHDRAWING AN ELEMENT FASTENED TO A MOBILE INSTALLATION FROM THE INFLUENCE OF THE MOVEMENTS OF THIS INSTALLATION

CROSS REFERENCE TO RELATED APPLICATIONS

This application is a continuation of application Ser. No. 559,073, filed Jul. 30, 1990 which, in turn, is a Continuation-in-Part of application Ser. No. 814,758 filed Dec. 30, 1985, both now abandoned.

FIELD OF THE INVENTION

The present invention relates to a device for insulating an element fastened to a mobile installation from the influence of movements of limited amplitudes of this installation.

BACKGROUND OF THE INVENTION

The device of the present invention may be used, for example, in the marine environment as an antipounding slide or pounding compensator. In fact, at sea, the swell causes, among other effects, the pounding or heave of floating equipment. When such equipment supports a well drilling apparatus, it is necessary to compensate for the pounding so that the drilling tool is permanently in contact with the bottom of the hole.

For compensation, three types of devices have generally been utilized, namely:

those which are placed in the drilling string, those which are inserted between the drilling string and the lifting system of the drilling apparatus, and those which are integrated in the lifting system.

The present invention, when it is applied to marine environment, relates to a compensator device integrated in the lifting system. This device forms part of those devices which solve the problem by making the fixed block movable, corresponding to the "crown block". This block will be designated hereinafter by the expression "first block" and the mobile block corresponding to the "travelling block" will be designated by the expression "second block".

The systems connected directly to the lifting device, in the prior art, generally comprise at least one actuating cylinder or jack itself connected to pneumatic accumulators, however, a disadvantage of the proposed systems resides in the fact that the pneumatic accumulators occupy a large volume.

Systems of the aforementioned type are described in, for example, U. S. Pat. Nos. 3,791,628 and 3,749,367, German Patent DE-A-2,221,700, and French Patent FR-A-95 453 as well as by the article entitled "Heave Compensating Devices" on page 4 and 8 of "Oil Report Review", No. 8, Sep. 10, 1973.

The volume of these accumulators is an important parameter in the determination of a lifting system.

Another important consideration is the variation of the force to be exerted on the second block as a function of the stroke of the mobile installation with respect to a constant value which the second block should withstand.

The difference between the real force and this constant value will be termed error.

The present invention reduces the volume of the accumulators and/or reduces the error.

SUMMARY OF THE INVENTION

Thus, the present invention relates to a device which fastens an element to a floating body or comparable mobile installation and reduces the influence of the movements of this installation with the device comprising first and second blocks relative to the sea bed floor or comparable reference object with the second block serving for fastening the element. The first block is connected to both the shaft of a first intermediate pulley and to the shaft of a second intermediate pulley by a first and second rod respectively. In a preferred embodiment, a first pulley and a second pulley is fixed with respect to the mobile installation, with the shaft of the first fixed pulley, respectively of the second fixed pulley, being connected by a third rod, respectively by a fourth rod, to the shaft of the first intermediate pulley, respectively of the second intermediate pulley, a first and a second retaining member. A cable connecting these two retaining members together passes successively, starting from the second retaining member, over the first fixed pulley, the first intermediate pulley, the first block and the second block while forming at least one loop. The second intermediate pulley and the second fixed pulley, at least one jack one end of which is connected to the first block and the other is connected to the mobile installation to operate in a vertical direction and at least one accumulator in hydra-pneumatic relation with the actuating cylinder. The first and second rods have an identical length equal to C, and the third and fourth rods also have an identical length equal to B, the semidistance separating the shaft of the first and second fixed pulleys being equal to A and the distance separating the shaft of the first block from the plane joining the shafts of the first and second pulleys is equal to G.

The device of the invention is characterized in that the magnitudes A, B, C, G and the passage of the cable are determined so that the mechanical and hydra-pneumatic forces $F_m$, $F_v$ are substantially equal over a portion at least of the stroke.

The device of the invention may comprise an auxiliary correction cylinder or jack whose force is adjustable.

The device of the invention may comprise a measuring means for measuring the force exerted by the second block and means for driving the auxiliary cylinder.

It is a further object of the invention to provide a device wherein the angle formed by the straight line joining the shaft of the first, respectively, the second, fixed pulley and the first, respectively the second, intermediate pulley with the straight line containing the portion of the cable joining these two pulleys together is at least equal to 30°.

This angle may be made equal to about 45°. Good results may be obtained with an angle close to 65° or more.

The first block may comprise ballasting means. In the case where the main actuating cylinder(s) or jack(s) are parallel to the stroke of the first block, the expression of the mechanical and hydro-pneumatic forces $F_m$, $F_v$ may be given respectively by the expressions:

$$F_m = Q + \frac{Q}{N}\left[\sin\beta\,\frac{\text{sine}\,\theta}{\text{sine}\,(\theta-\phi)} + \text{sine}\,(\theta+\gamma) - \text{sine}\,\theta\,\frac{\text{sine}\,(\theta+\gamma-\phi)}{\text{sine}\,(\theta-\phi)}\right] + U$$

and

-continued $$F_v = P_g S_v \left[ 1 - \frac{1}{K} (1 - R_{educed\ stroke}) \right]^{-\gamma}$$

in which:

Q=force coming from all that contributes to the tension of the cable,

N=number of strands of the second block

U=fraction of $F_m$ independent of the tension of the cables,

β=angle formed by the strand of the cable between the fixed pulley and the intermediate pulley and the straight line joining the centers of these two pulleys, ϕ=angle defined by the direction of the straight line joining the center of the first and second fixed pulleys and the direction of the straight line joining the axes of the first fixed pulley and of the first intermediate pulley, γ=angle formed by the cable strand joining the intermediate pulley and the pulley of the block and a straight line joining the centers of these two pulleys, Θ=angle formed by the direction of the straight line joining the center of the first and second fixed pulleys and the direction of the straight line joining the centers of the first block and of the first intermediate pulley;

$P_g$=preinflation pressure of the accumulators, $S_v$=a cross-section of the actuating cylinders, $K=V_a/S_vC_{cdc}$, with:

$V_a$=a volume of the accumulators, $C_{cdc}$=a total stroke of the first block, Reduced stroke=actual stroke/$C_{cdc}$ $\gamma^1$=an expansion coefficient of gases.

The magnitudes A, B, C, G and the path of the cable may be determined for making the linearized expressions of $F_m$ and $F_v$ identical.

The expression of the hydro-pneumatic forces may be linearized by only considering the forces given by the mathematical expression of these forces in two limit positions of the travel of the first block.

The present invention also relates to a method for determining the geometry of a device for withdrawing from the influence of the movements of this installation an element fastened to a mobile installation, this device comprising a first and a second block, this latter serving for fastening said element, the first block being connected both to the shaft of a first intermediate pulley and to the shaft of a second intermediate pulley by a first and second rod respectively, a first pulley and a second pulley fixed with respect to the mobile installation, the shaft of the first fixed pulley, respectively of the second fixed pulley, being connected by a third rod, respectively by a fourth rod, to the shaft of the first intermediate pulley respectively of the second intermediate pulley, a first and a second retaining member, a cable connecting these two retaining members together while passing, successively, from the second retaining member, over the first fixed pulley, the first intermediate pulley, the first block and the second block while forming at least one loop, the second intermediate pulley and the second fixed pulley, at least one actuating cylinder one end of which is connected to the first block and the other is connected to the mobile installation and at least one accumulator in a hydro-pneumatic relation with the actuating cylinder, the first and the second rods having an identical length equal to C, and similarly the third and fourth rods have an identical length equal to B, the semidistance separating the axis of the first and of the second fixed pulleys being equal to A and the distance separating the axis of the first block from the plane joining the axes of the first and second pulleys is equal to G.

In this method, the magnitudes A, B, C and G and the passage of the cable are determined so that the mechanical force $F_m$ and hydro-pneumatic force $F_v$ are substantially equal over at least a portion of the stroke.

Alternately, the magnitudes A, B, C and G and passage of the cable may be determined so that the linearized expressions of the mechanical force $F_m$ and hydro-pneumatic force $F_v$ correspond to curves parallel with each other.

It is also possible for the magnitudes A, B, C, G and passage of the cable to be determined so that the linearized expressions of the mechanical force $F_m$ and hydro-pneumatic force $F_v$ correspond to curves having at least one common point.

BRIEF DESCRIPTION OF THE DRAWINGS

The present invention will be better understood and its advantages will be more clearly understood from the following description of a particular embodiment, illustrated by the accompanying drawings.

DETAILED DESCRIPTION

Figure 1:
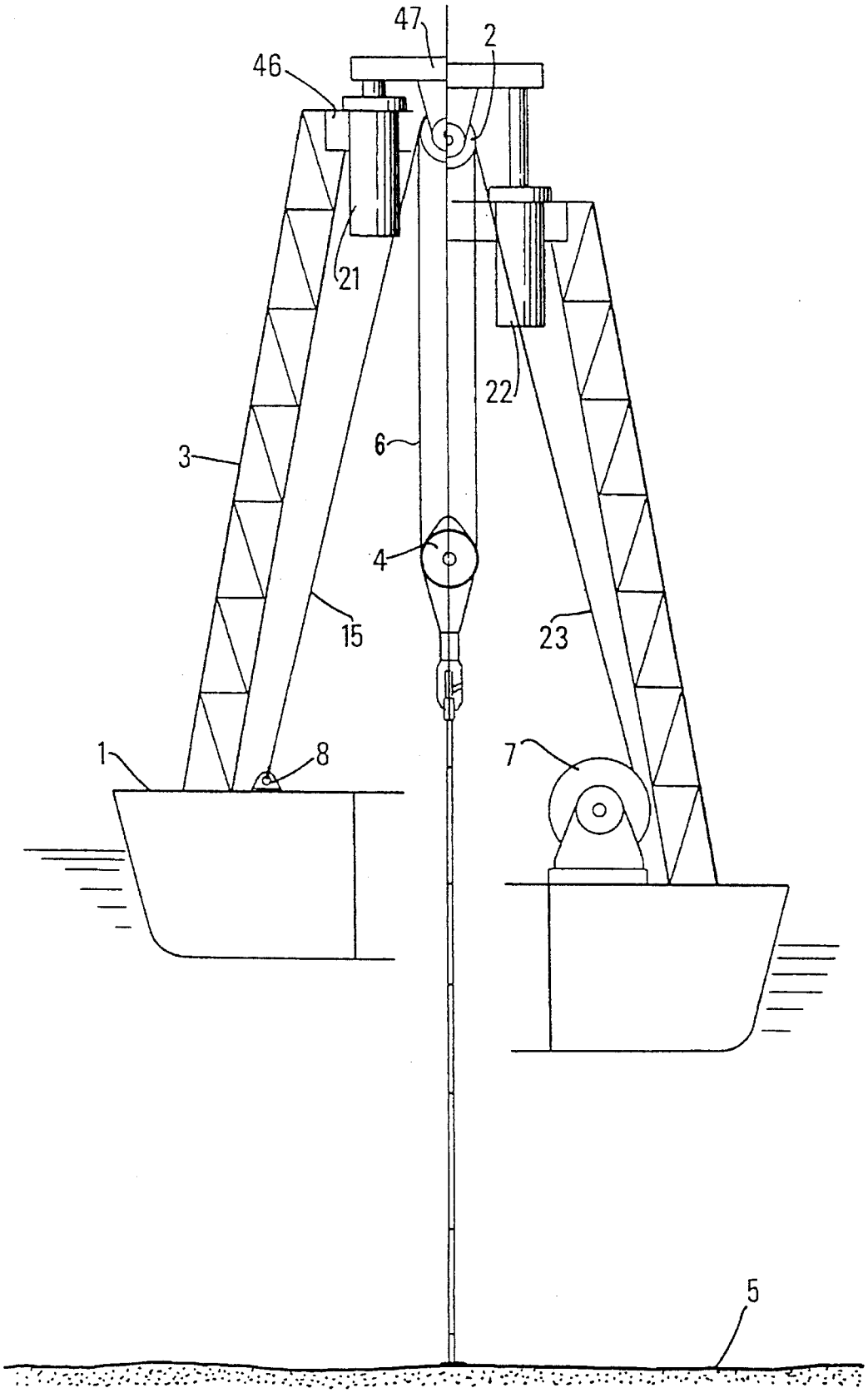
FIG. 1 (PRIOR ART)
FIG. 1 shows a simple compensator device of the prior art, the right hand and left hand parts of this figure corresponding to different positions of a mobile installation.

An example described below relates to a loop compensation system as illustrated in FIG. 1.

It is recalled that, when the pounding of a floating body or installation 1 is compensated for by movement of a first block 2 with respect to the derrick 3 of a drilling apparatus, for example, it is necessary and sufficient to move the first block 2 by a distance less than the amplitude of the pounding or wave action so that the second block 4 is immobile with respect to the sea bed 5.

If, in fact, the distance from the sea bed 5 to the floating body 1 increases, the distance from the first block 2 to the floating body 1 must decrease. But, if the arrangement is based on a constant length of cable 6, since the first block 2 draws closer to winch 7 and the fixed point 8, the second block 4 moves away from the first one. The stroke for compensating the pounding is therefore less than amplitude of pounding or vertical movement of the mobile installation caused by wave action.

However, during this movement, the cable 6 is wound on and off the pulleys of both of blocks 2 and 4 and this is unacceptable from the point of view of working of the cable. On the other hand, the tension in the different portions of the cable has remained constant, movement of the first block 2 only causing negligible variations of the angle of the dead and fast strands of the cable with the feet of the derrick.

Thus, then movement of the first block 2, i.e. the variation of the distance from the first block 2 to winch 7 must not cause a variation in length of the path of cable 6.

Figure 2:
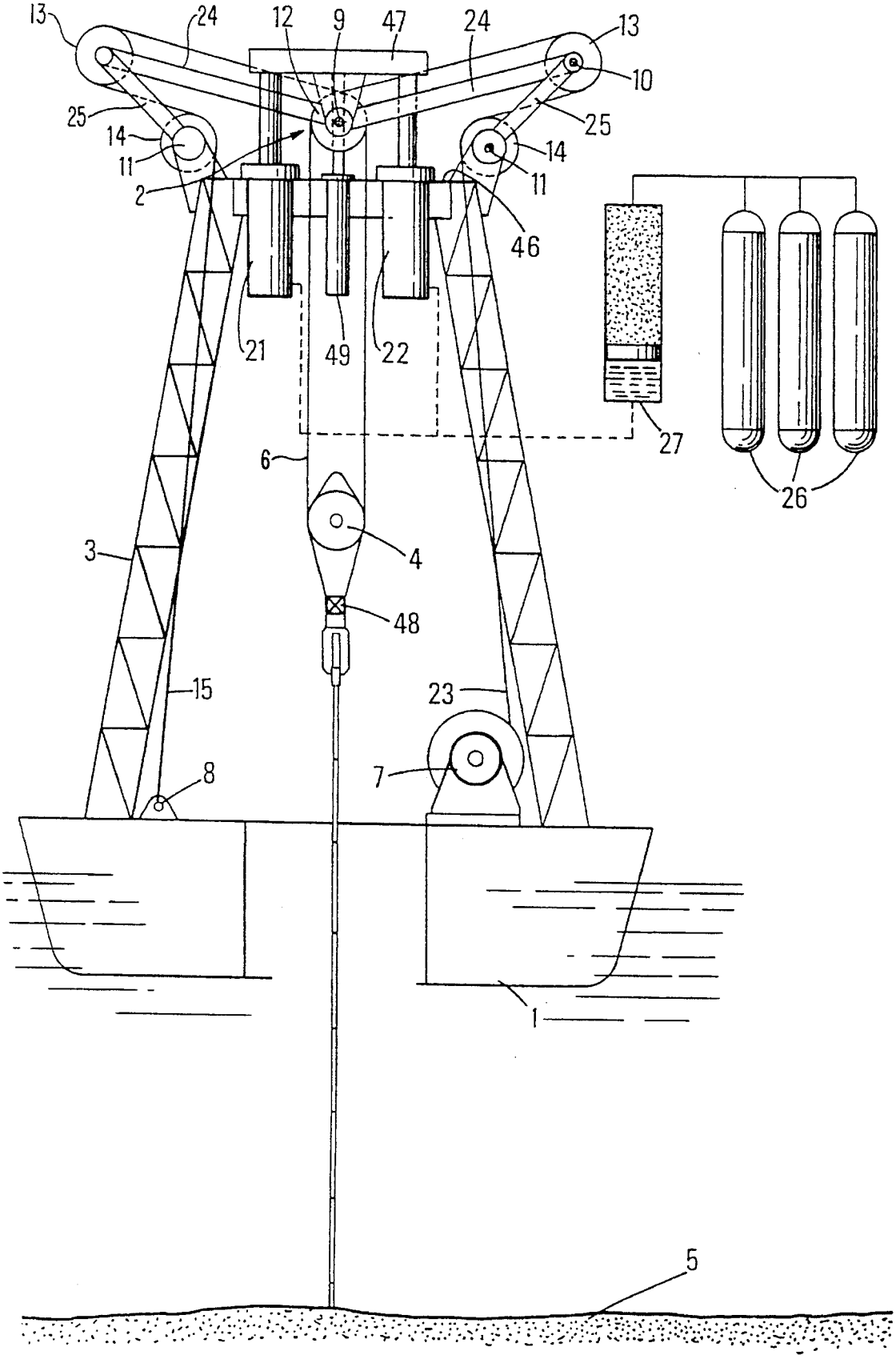
FIG. 2 is an elevation of a floating derrick having a pulley arrangement in accordance with the present invention.

It is sufficient to provide, for example FIG. 2, a cable path such that it passes through two sides of fixed length of a deformable triangle, the third side of variable length, which ensures the variation of distance from the first block to the floating body, not being travelled over by the cable.

With continued reference to FIG. 2 the apices of this triangle correspond to the centers 9, 10 and 11 of pulleys 12, 13, 14 over which the cable passes. It can be shown that the cable length remains strictly constant if the pulleys have the same diameter.

If intermediate pulley 13 is situated above fixed pulley 14 and if the triangle has only acute angles, the cable path will intersect one side.

When the variation of length of the cable path 6 is not compensated for, all the suspended load, which may be a drill string which extends into the ground as illustrated in FIG. 2 as strands 6, is supported by the cylinders 21 and 22 before being supported by the feet of derrick or mast 3. See also FIG. 1.

When this variation is compensated for, a part of the load and of the tension of the dead strand and fast moving stands 23 is transferred directly to the derrick or mast 3 through arms, or rods 24 and 25 of the device without passing through the cylinders 21, 22 (FIG. 2).

This load fraction not passing through the cylinders 21 and 22 varies depending on the position of the first block 2 or its pulley 12 and the law according to which this variation takes place depends on the geometric characteristics of the compensation device and of its position with respect to derrick or mast 3.

If then the variation of length is not compensated for, in order to balance a constant load, whatever the position of the first block 2, the pressure in cylinders 21, 22 must be held constant. In the case of FIG. 2, reference 27 designates a liquid gas separator.

If the pressure is held constant by means of gas accumulators 26, the volume thereof must be as large as possible so that the pressure variation due to the polytropic expansion of the gas is as low as possible.

If, on the other hand, the variation of length is compensated for a constant suspended load, the apparent load on the cylinders is variable.

By dimensioning and positioning the system, it can be arranged that, for a constant suspended load, the apparent load variation is greater or lesser.

If this variation is small, we come back in practice to the problem discussed above.

On the other hand, if the apparent load variation is large, the compensation may still be satisfactory provided that the variation is substantially identical to the pressure variation caused by the polytropic expansion of the gas of the accumulators.

This tangible identity of the apparent variation of the load on the cylinders and of the pressure variation due to the polytropic expansion forms the principle of the proposed compensation method.

Figure 3:
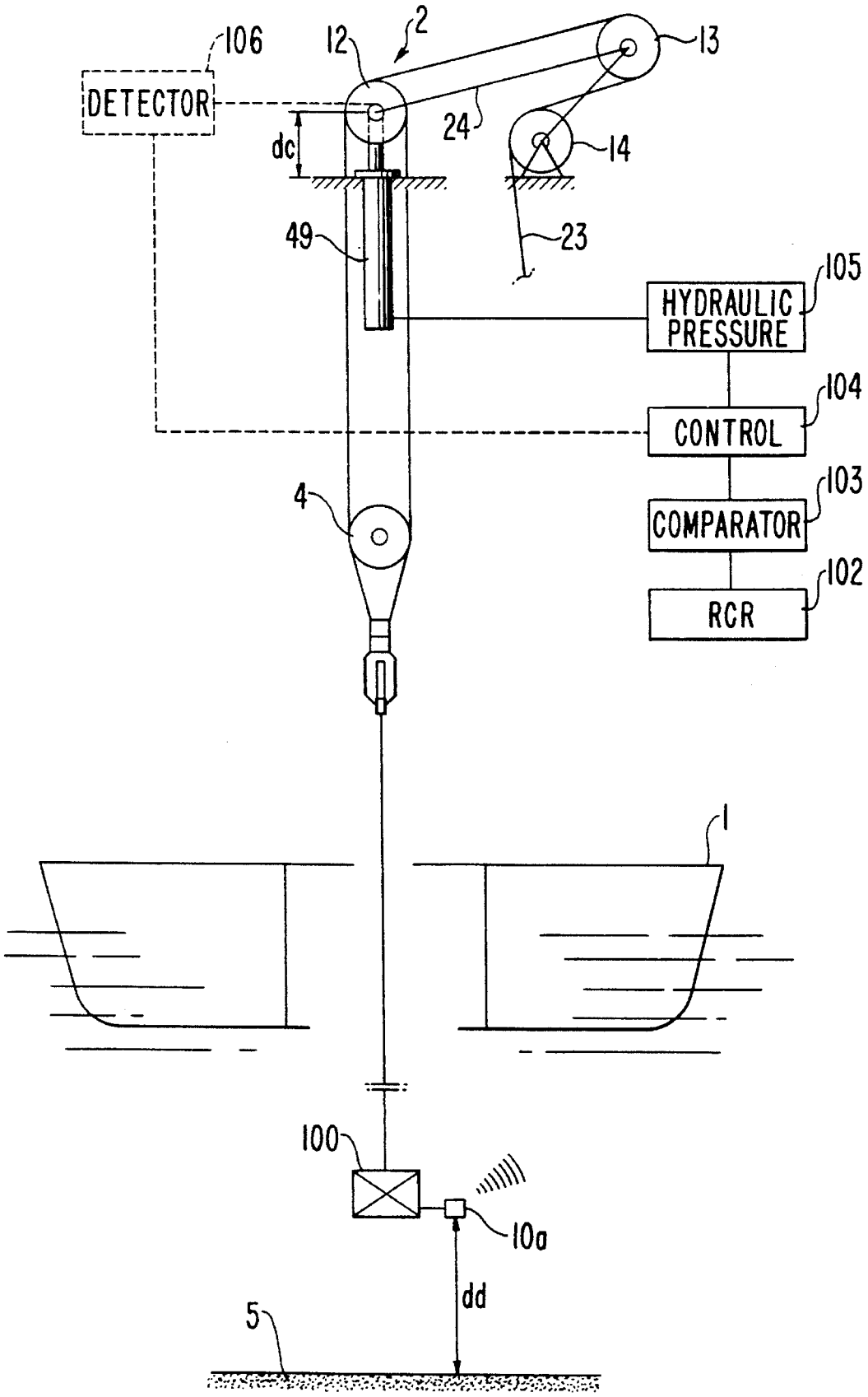
FIG. 3 is a view of the derrick of FIG. 2 with some of the parts removed to illustrate an auxiliary correction cylinder and control equipment.

In FIG. 3, the embodiment may be identical to FIG. 2 but only the right hand half of the cable path is illustrated wherein the first block having pulley 12 is supported on the piston rod of an auxiliary correction cylinder 49 and the second block 4 suspends a constant load 100 at a distance dd from the floor bed 5. A transmitter 10*a* transmits a signal corresponding to the distance dd to a receiver 102 whose output is connected to comparator 103. The fluid pressure supplied to cylinder 49 from a pressure unit 105 is under the influence of an output signal from control 104.

Supplemental to or as an alternative for the position sensing arrangement using transmitter 10a, the position of pulley 12 may be controlled by a monitoring device 106 which is responsive to a kinematic characteristic such as rotation or vertical acceleration of pulley 12 or by the vertical position with respect to a land reference marks sometimes referred to as a Gallilean mark.

In the device of FIG. 3 the second block 4 from which the load 100 is fastened is suspended vertically below pulley 12 that is part of the first block. A first rod 24 extends between the shafts of pulleys 12 and intermediate pulley 13. A further rod 25 extends between the shafts of intermediate pulley 13 and pulley 14 which is fixed to the derrick so that intermediate pulley 13 moves in an arcuate path about the rotational axis of pulley 14 as the distance dc varies when pulley 12 maintains a constant distance above sea floor 5 and the mobile installation is subject to wave action.

The cable 23 extends as illustrated in FIG. 2 from a fixed position, e.g. winch 7, on the floating installation over the side of pulley 14 nearest the vertical axis between pulley 12 and block 4. The cable continues to the side of pulley 13 that is remote from the vertical axis thereby crossing rod 25 and forming an angle of at least 30° with a straight line joining the axes of intermediate pulley 13 and fixed pulley 14.

The attachment of cable 23 on the left hand side is preferably by means of a pulley arrangement as illustrated in FIG. 2 on the left hand side of the vertical axis passing through pulleys 4 and 12.

Concerning the optional use of auxiliary correcting jack 49 and means for piloting these auxiliary jacks, it is on occasion necessary to control the weight on the tool. In drilling the weight required on the tool may be assumed to be 15 tons. Pulley block 4 would thus have to support the weight of all the fittings minus 15 tons. If the weight of these entire fittings is 100 tons, pulley block 4 would have to support a weight of 85 tons, or 100 minus 15.

The device according to the invention minimizes the difference between the load actually supported by the pulley 12 or pulley block 2 and the ideal load desired, which is constant whatever the position of pulley block 2.

The maximum difference may be, for example, for a given dimensioning of the proposed structure and of the air reserve according to the present invention: 2 tons. In this case, it is not necessary to have a correcting jack and the weight on the tool will be 15±2 tons, i.e. between 13 and 17 tons.

Thus, it appears clearly that the device according to the present invention does not necessarily require the use of auxiliary correcting jacks.

In the same example, a device according to the prior art, without the use of correcting jacks, would not have provided such a small difference as that obtained by the device according to the invention. It is not infrequent for devices according to the prior art, in the absence of correcting means, to have differences greater than 15 tons, which corresponds to the case in point where the tool would leave the cutting surface at the bottom of the drill hole. This is particularly injurious to the drilling tool.

In the device according to this feature of the present invention, the use of correcting jacks does allow this difference to be reduced even further, and made less than 2 tons if desired.

However, the main useful point about correcting jack or jacks 49 is the case where the device according to the invention is used to manipulate a load suspended from the second pulley block 4 and which does not rest on the ground.

At this point in time, a correcting jack allows the position of this load to be predetermined with respect to the sea bed, and measuring means may be used to maintain the distance between the load and the sea bed, and correct this position by the auxiliary jack 49 and its controller whose function it is to monitor this distance and keep it constant.

In this FIG. 3 reference 5 designates the sea bed, reference 1 the mobile system, and reference 100A designates the load to be supported. Reference dd corresponds to the distance between the sea bed and the load to be supported. Reference 101 designates means for measuring this distance dd. These means 101 are equipped with a transmitter transmitting the information corresponding to distance dd, to a receiver 102. This receiver 102 transmits the information to a comparator 103 which measures the difference between distance dd obtained and the desired distance, and send the difference information to control means 104 which control a hydraulic system 105. This system sends, to correcting jack 49, the pressure that is required to regulate the distance dd separating the load from the sea bed.

Alternatively, jack 49 can be controlled by at least one kinematic characteristic of pulley 12. Such a characteristic may be the vertical acceleration of pulley 12 or, preferably, its vertical position on a reference mark connected to the land (Gallilean mark).

Indeed, the goal of the present invention is, in normal weather, to keep pulley 12 at a fixed point in space. Thus, according to a preferred embodiment, an inertial system integral with pulley 12 can be used, which furnishes the difference between the position of pulley 12 and a preset value.

The information of which this difference is composed is transmitted directly to control means 104. This embodiment is shown in dashed lines in FIG. 3.

According to one variant of this embodiment, the inertial system of the ship could be used, and thus be integral with the ship, and the information supplied by this system could be continuously corrected by direct measurement linked to the pulley 12. In FIG. 3 this distance is designated "dc".

Figure 4C:
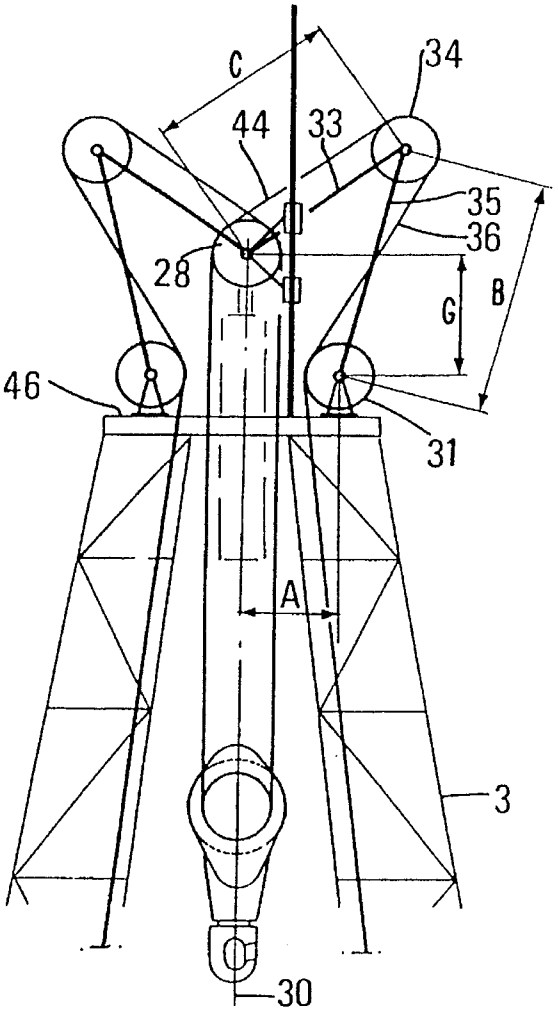
FIGS. 4*a* to 4*c* show schematically different positions of the device of the invention in operation.
Figure 4B:
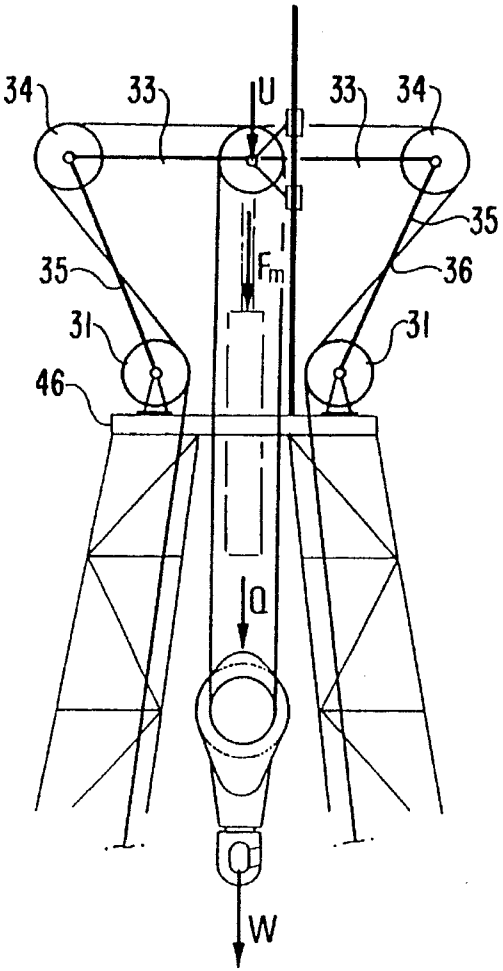
Figure 4A:
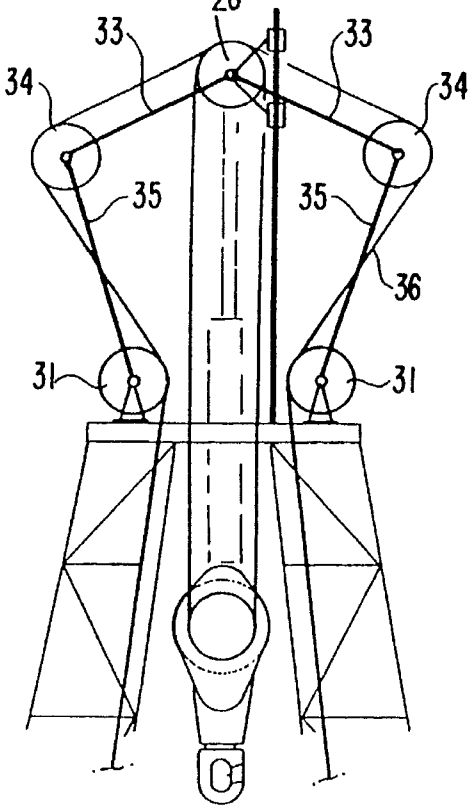

The compensation system is positioned with respect to the low position of the first block 28 once the magnitudes of distances A and G have been chosen (FIG. 4).

A is the distance from the center of the guide pulley or fixed pulley 29 to the axis 30 of the derrick 3 and G the difference of the dimensions from the center 31 of the guide pulley 29 and the center 32 of the pulleys of the first block 28 when these latter are in the low position (case of FIG. 4*c*).

The system is dimensioned by the lengths B and C of the articulated arms or rods 33 and 35. It is in fact possible, once these dimensions are known, to position the intermediate pulley 34 whatever the travel distance.

The device will be perfectly defined once the path of the cable has been defined, i.e. when the passage direction of the cable over the pulleys and the dimensions thereof as well as the position of the cylinders, in this case their inclination with respect to the stroke, have been defined.

The law of variation of the apparent load on the cylinders will therefore depend, in so far as the geometry of the system is concerned and for each stroke distance fixed by the specifications, on six independent parameters.

To simplify the description, it will be considered hereafter that the tilt of the cylinders with respect to the direction of the stroke is zero.

The mechanical force $F_m$ which the system exerts on the top of the derrick 3 generally designated by the term "water-table" may be considered as the result of two forces U and Q with U being defined as the fraction of the mechanical force $F_m$ independent of the tension of the cables.

U will itself be considered later as the sum of two forces $U_f$ and $U_c$, $U_c$ being the fraction of U dependent on the stroke.

$U_f$, independent of the stroke, corresponds to the weights of the mobile elements fixed to the support carriage 47 of the first block and driven at the same time as it with a linear movement corresponding to the pounding (first block, cylinder rods, etc.).

$U_c$ corresponds to the fraction of the weight of the intermediate pulley 33 and of the links, arms or rods, which is transferred to the carriage of the first block. This is a function of the stroke but also depends on the positioning and dimensioning of the system.

The force Q comes from all that contributes to the tension of the cables, i.e. from the suspended load W, from the weight of the second block and from the weight of the cables themselves.

It also depends, all other things being equal, on the dimensioning and positioning of the device, on the travel, and of course on the number of strands N of the reeving.

The most general expression of the mechanical force $F_m$, as a function of the angles β, γ, Θ and ϕ which are themselves explained by the stroke and magnitudes which determine the positioning and dimensioning, is written:

$$\frac{F_m}{Q} = 1 + \frac{1}{N}\left[\text{sine}\beta\frac{\text{sine}\,\theta}{\text{sine}\,(\theta-\phi)} + \text{sine}\,(\theta+\gamma) - \text{sine}\,\theta\frac{\text{sine}\,(\theta+\gamma-\phi)}{\text{sine}\,(\theta-\phi)}\right] + \frac{U}{Q} \quad (1)$$

Figure 5:
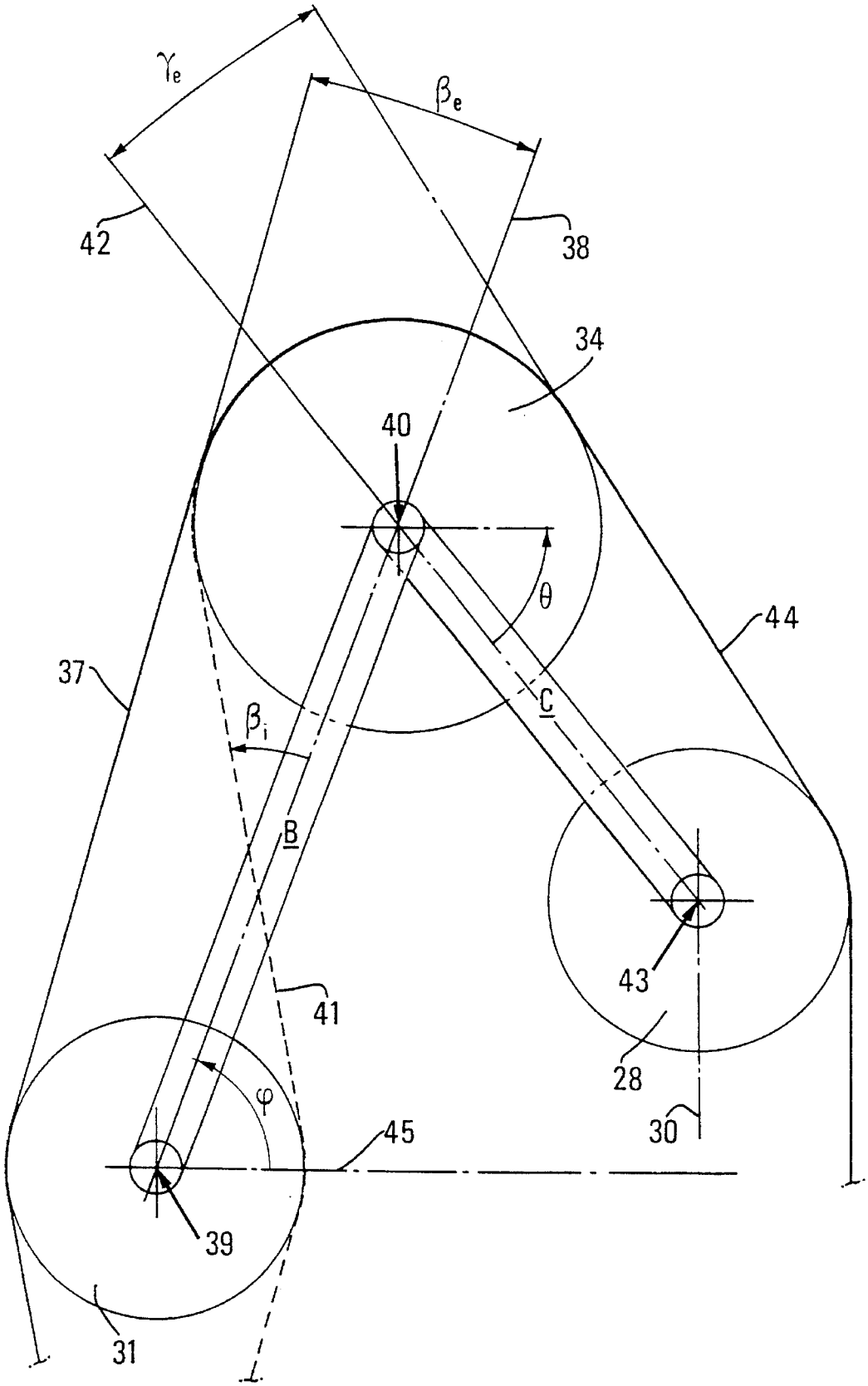
FIG. 5 is an explanatory diagram for defining certain variables which characterized the device of the invention.

FIG. 5 defines the angles β, γ, Θ and ϕ.

In FIG. 5, the reference 30 designates the axis of the derrick 3, the reference numeral 28 a pulley of the first block, the reference numeral 34 an intermediate pulley and reference 31 a guide pulley or fixed pulley.

Angle β is the angle formed by the cable strand between the fixed pulley 31 and the intermediate pulley 34 and the straight line 38 joining the center 39 and 40 of these two pulleys. In FIG. 5, two path variants of the cable have been considered, one of these paths drawn with a thick line, is designated by the reference 37 and the other in broken lines is designated by the reference 41, the first defines the angle βe and the section the angle βi.

The angle γ is defined by the cable strands joining the intermediate pulley 34 and the pulley of block 28 and the straight line 42 joining the centers 40 and 43 of these two pulleys.

In FIG. 5, the path of the strand of cable 44 has been shown passing outside the two pulleys and defining the angle γe.

The angle ϕ is defined by the horizontal direction 45 and the direction of the straight line 38. Similarly the angle Θ is defined by the direction of the straight line 42 and the horizontal direction.

It is recalled that β and γ are independent of the stroke and only dependent on the dimensioning of the system whereas Θ and ϕ depend on the dimensioning and on the stroke.

If the intermediate pulley 34 is situated below the top 46 of the mast or derrick 3 (FIG. 3, left hand part) β and γ cannot be zero and it is the most general formula which applies.

If the intermediate pulley is situated above the plate situated at the top of the mast or derrick 3, designated by the term "water-table", but beyond the guide pulley with respect to the pulleys of the first block 2, the angle $\gamma$ is zero if the intermediate pulleys and the pulleys of the first block have the same diameter (FIG. 2, right hand part and FIG. 5).

The expression of $F_m/Q$ is simplified and becomes $$\frac{F_m}{Q} = 1 + \frac{1}{N} \text{ sine } \beta \frac{\text{sine } \theta}{\text{sine } (\theta - \phi)} + \frac{U}{Q} \tag{2}$$

If the intermediate pulley still situated above the water table is also "between" the guide pulley and the crown block pulleys, and if these latter have the same diameter, the $\beta$ is also zero and the expression of Fm/Q becomes:

$$\frac{F_m}{Q} = 1 + \frac{U}{Q} \tag{3}$$

(FIG. 3, right hand part and FIG. 5)

It is therefore independent not only of the dimensioning and the positioning but also of the stroke.

This latter case which amounts to obtaining, over the whole stroke distance of an hydro-pneumatic system, the most constant force possible is well known from the prior art.

P and V designate the gas pressure and volume of the accumulators when the stroke distance of the cylinders is equivalent to x, between O and $C_{cdc}$. $P_g$ and $V_a$ designate the preinflation pressure and the volume of the accumulators, i.e. their gas pressure and volume when the cylinders have effected the whole of their stroke $C_{cdc}$, and $P_M$ the maximum pressure for the service considered, i.e. that which appears when the cylinders are at the beginning of their stroke.

The hydro-pneumatic force $F_v$ delivered by the cylinders as a function of the stroke is written:

$$\frac{F_v}{S_v} = P_g \left[ 1 - \frac{1}{K} (1 - R_{educed\ stroke}) \right]^{-\gamma} = P_m \left[ 1 + \frac{R_{educed\ stroke}}{K-1} \right]^{-\gamma} \tag{4}$$

–"$R_{educed\ stroke}$" is the non dimensioned expression of the stroke, i.e. its value divided by the total stroke $C_{cdc}$ fixed by the specifications $$\left( R_{educed\ stroke} = \frac{x}{C_{cdc}} \right)$$

–K is also a variable without dimension. It is equal to the volume $V_a$ of the accumulators divided by the total stroke $C_{cdc}$ and by the section $S_v$ of the cylinders ($K=V_a/S_v.C_{cdc}$).

In the zone where the polytropic expansion of the gas will be used, K will be between 5 and 50 (and even generally close to 10) and $R_{educed\ stroke}$ between 0 and 1.

Figure 6:
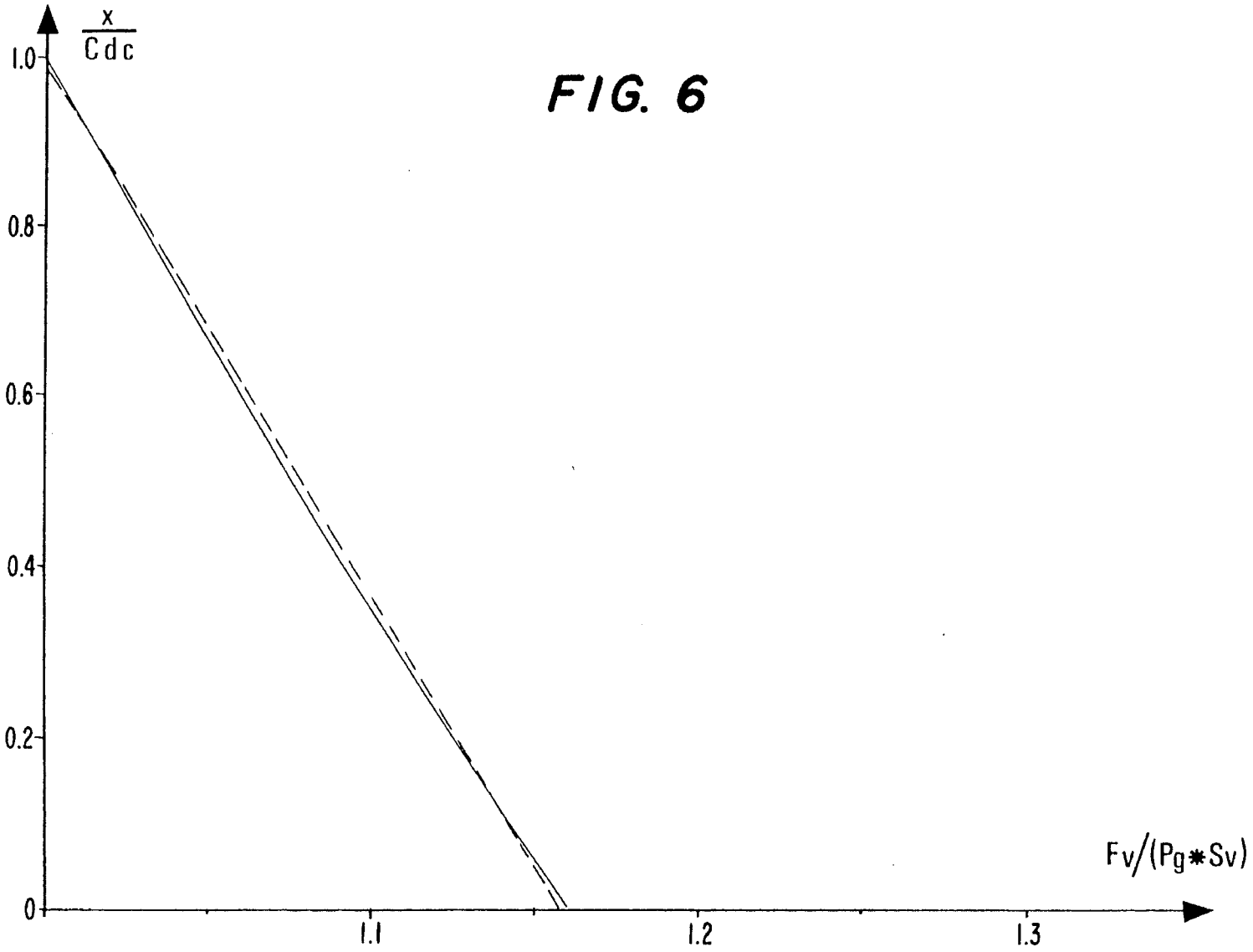
FIG. 6 shows the response of the mechanical system and of the hydra-pneumatic system.

In this zone (FIG. 6), the representation of $$\frac{F_v}{Pg \cdot S_v}$$

is practically a straight line.

This phenomena may be linearized, with an accuracy of a few thousandths, using for example the minimum quadratic deviation method and thus we may write:

$$\frac{F_v}{S_v} = P_g \left[ A_d(K) \cdot R_{educed\ stroke} + B_d(K) \right] \tag{5}$$

$$= P_m \left[ A'_d(K) \cdot R_{educed\ stroke} + B'_d(K) \right] \tag{6}$$

K, $A_d(K)$, $B_d(K)$, $A'_d(K)$ and $B'_d(K)$ are values which are determined once a single one of them is determined.

In fact, for all the operating pressures P, the polytropic expansion may always be linearized and a straight line found such that:

$$\frac{F_v}{P \cdot S_v} = a_d(K) \cdot R_{educed\ stroke} + b_d(K) \tag{7}$$

It has been established that the most general expression of the mechanical force $F_m$ which the system applies to the cylinders, related to the load Q (that which contributes to the tensioning of the cables) is written:

$$\frac{F_m}{Q} = 1 + \frac{1}{N} \left[ \text{sine}\beta \frac{\text{sine } \theta}{\text{sine } (\theta - \phi)} + \text{sine } (\theta + \gamma) - \text{sine } \theta \frac{\text{sine } (\theta + \gamma - \phi)}{\text{sine } (\theta - \phi)} \right] + \frac{U}{Q} \tag{8}$$

The angles $\beta$, $\gamma$, $\Theta$, and $\phi$ assume a well defined value, on the one hand, for each position of the first block and, on the other, for each of the values which have been fixed for the five independent geometric parameters which position and dimension the device.

It is also possible to linearize this expression as was done for the response of the cylinders and still using for example the minimum quadratic deviation method.

In fact, if it is done by supposing that U is zero, we may write:

$$\frac{F_m}{Q} = Am \cdot R_{educed\ stroke} + B_m(U=0) + \frac{U}{Q} \tag{9}$$

The most satisfactory geometries of the system are those which make the mechanical $F_m$ and hydro-pneumatic $F_v$ responses the closest to each other over the whole of the stroke. The forces $F_m$ and $F_v$ may be expressed by the formula (1) and (4).

Geometries of the system may be determined by making simpler linearized equations identical, for example for the hydro-pneumatic system:

$$\frac{F_v}{P \cdot S_v} = a_d \cdot R_{educed\ stroke} + b_d \tag{10}$$

and for the mechanical system:

$$\frac{F_m}{Q} = A_m \cdot R_{educed\ stroke} + B_m + \frac{U}{Q} \tag{11}$$

For that we must have $$(1)\ P \cdot Sv = Q \qquad (2)\ a_d = A_m \qquad (3)\ b_d = B_m + \frac{U}{Q} \tag{12}$$

for all the values of Q less than the load $Q_{MAX}$ fixed by the specifications.

U is here assumed independent of the stroke. This is not strictly exact, but that considerably simplifies the present description and will simplify it even more in the second part without for all that introducing inaccuracies. It is a fact sufficient, with the above defined notations, to write the most general expression by replacing U by $U_f+U_c$. The linearization is then written:

$$\frac{F_m}{Q} = A'_m \cdot R_{educed\ stroke} + B'_m + \frac{U_f}{Q} \tag{13}$$

where $A'_m$, $B'_m$ and $U_f$ are slightly different from $A_m$, $B_m$ and U.

Only the computing programs will work with $A'_m$, $B'_m$ and $U_f$. The description will be made with $A_m$, $B_m$, and U which changes nothing since the expressions of the formula are identical.

In fact, it is possible to keep the analytic expression of the response of the hydro-pneumatic system rather than the linearized expression since, as we have seen, the analytic expression is almost perfectly linear.

Values of the pressure at each end of the stroke will be used which follow from the formula already given. It will be assumed that the response of this system is linear between these two points.

The initial state and the final state of the transformation are linked by the relationship:

$$P_g V_a^{\gamma} = P_M (V_a - S_v . C_{cdc})^{\gamma} \quad (14)$$

which may be written:

$$V_a/(S_v \cdot C_{cdc}) = K = \frac{1}{1 - \left[\frac{P_M}{P_g}\right]^{-\frac{1}{\gamma}}} \quad (15)$$

On the other hand, the linearized response of the mechanical system is represented by:

$$F_m = Q(A_m R_{educed\ stroke} + B_m) + U \quad (16)$$

At each end of the stroke, this expression is written:

$$F_{mm} = Q(A_m + B_m) + U \quad (17)$$

$$F_{mM} = Q\, B_m + U \quad (18)$$

but $$F_{mm} = P_g \cdot S_v \text{ and } F_{mM} = P_M \cdot S_v \quad (19)$$

thus $$\frac{F_{mM}}{F_{mm}} = \frac{P_M}{P_g} = \frac{B_m + U/Q}{A_m + B_m + U/Q} \quad (20)$$

Moreover, the specifications always fix the extreme operating conditions, namely the maximum pressure $P_{MAX}$ which must not be exceeded in the circuit and the maximum load which must be able to be handled, and which determines $Q_{MAX}$.

Knowing that, on the one hand, the operation with maximum load results in the appearance of the highest pressure and that, on the other hand, for a given load the pressure is maximum when the stroke is zero, it is possible to write:

$$F_{mMAX} = Q_{MAX} \cdot B_M + U \quad (21)$$

and $$F_{mMAX} = S_v \cdot P_{MAX} \quad (22)$$

therefore $$S_v = \frac{Q_{MAX} \cdot B_m + U}{P_{MAX}} \quad (23)$$

With the specifications fixing $P_{MAX}$ and allowing $Q_{MAX}$ to be known, and with the design department determining U, the section of the cylinders is known through the preceding formula once the mechanical system is dimensioned and positioned.

It is then also possible to determined the air volume of the accumulators which results in the hydro-pneumatic and mechanical systems having responses represented by straight lines with the same slope for a load Q.

For that, it is necessary that:

$$\frac{V_a}{S_v \cdot C_{cdc}} = K \frac{1}{1 - \left[\frac{P_M}{P_g}\right]^{-\frac{1}{\gamma}}} = \quad (24)$$

-continued $$\frac{1}{1 - \left[\frac{B_m + U/Q}{A_m + B_m + U/Q}\right]^{-\frac{1}{\gamma}}}$$

It then remains to cause the now parallel straight lines which represent the responses of the mechanical and hydro-pneumatic systems to merge.

That amounts to fixing the operation pressure at a point of the stroke of abscissa Reduced stroke to a value such that at a point $F_m = F_v$, i.e.:

$$Q(A_m \cdot R_{educed\ stroke} + B_m) + U = P \cdot S_v \quad (25)$$

but $$P \cdot S_v = P_M S_v \left[1 + \frac{R_{educed\ stroke}}{K-1}\right]^{-\gamma} = P_g S_v \left[1 - \frac{1 - R_{educed\ stroke}}{K}\right]^{-\gamma} \quad (26)$$

therefore $$P_M = Q \frac{A_m \cdot R_{educed\ stroke} + B_m + U/Q}{S_v \left[1 + \frac{R_{educed\ stroke}}{K-1}\right]^{-\gamma}} \quad (27)$$

and $$P_g = Q \frac{A_m \cdot R_{educed\ stroke} + B_m + U/Q}{S_v \left[1 - \frac{R_{educed\ stroke}}{K}\right]^{-\gamma}} \quad (28)$$

If the point common to the mechanical and hydraulic response is chosen so that $R_{educed\ stroke}=0$, the expression of $P_M$ is simple and is written:

$$P_m = Q \frac{B_m + U/Q}{S_v} \quad (29)$$

If it is chosen for the value of $R_{educed\ stroke}=1$, it is the expression of $P_g$ which becomes simple and is written:

$$P_g = Q \frac{A_m + B_m + U/Q}{S_v} \quad (30)$$

Thus for the given specifications and for a given mechanical system, it is possible to define a hydro-pneumatic system (cylinder section, air reserve of the accumulators and inflation pressure) whose response is identical to the linearized response of the mechanical system for any value of the useful load.

Since the normal use of the drilling apparatus involves a whole range of effective loads, it is necessary either to adapt the hydro-pneumatic system to each effective load (by varying for example the volume of the air reserve of the accumulators by ballasting), or adapt the mechanical system to a given hydro-pneumatic system (by artificially varying, for example, the weight U). Otherwise, an error must be admitted.

It is recalled that:

U is, if the whole of the moving pieces is considered, the sum of the weights of those which do not contribute to the tension of the cables, Q is, conversely, the sum of the weights of those which contribute to the tension of the cables, after varying the five independent parameters which position and dimension each mechanical device, only those are retained whose response may be considered as linear and expressed by:

$$\frac{F_m}{Q} = A_m R_{educed\ stroke} + B_m + \frac{U}{Q} \tag{31}$$

The use of the apparatus throughout the range of all the useful loads will cause Q to vary from $Q_{min}$ to $Q_{max}$, and the pressure in the hydraulic circuit will never have to exceed a value fixed by the specifications and which is called PMAX.

Let us assume that one of the mechanical devices has been selected. $A_m$ and $B_m$ are then determined by calculation and U by the design of the constructor.

Let $U_{const}$ be this value.

The section of the cylinders is therefore known, since it is determined by the formula:

$$S_v = \frac{Q_{MAX} \cdot B_m + U_{const}}{P_{MAX}} \tag{32}$$

The volume of the air reserve of the accumulators is then determined when any load Q has been fixed, which will be called $Q_{exact}$, and for which the responses of the mechanical and hydro-pneumatic systems are parallel.

This arbitrary value $Q_{exact}$ of the load Q in fact allows the air reserve $V_a$ of the accumulators to be determined (volume occupied by the air in the hydro-pneumatic circuit when the $R_{educed\ stroke}$ is equal to 1) since:

$$\frac{V_a}{S_v \cdot C_{cdc}} = K = \frac{1}{1 - \left[\frac{B_m + U_{const}/Q_{exact}}{A_m + B_m + U_{const}/Q_{const}}\right]^{-\frac{1}{\gamma}}} \tag{33}$$

Finally, the operating pressure is determined by writing, for any point of the stroke, that the mechanical and hydro-pneumatic responses are equal at this point. The two response curves, already parallel, then become merged.

If it is decided to determined the maximum pressure for this load, i.e. the pressure at a zero stroke we have:

$$P_M + Q_{exact} \frac{B_m + U_{const}/Q_{exact}}{S_v} \tag{34}$$

It has just been shown that for an arbitrary value $Q_{exact}$ of the load Q, the intrinsic response of the compensation system, i.e. the difference between the mechanical and hydro-pneumatic responses, could be practically reduced to the sole error of linearization of the response of the mechanical system.

This latter, moreover generally low, may be made extremely reduced at the price of a constraint which will be explained further on.

It is therefore possible to calculate the volume of the air reserve of the accumulators by successively choosing $Q_{exact}$ equal to $Q_{min}$ then to $Q_{MAX}$.

In a first solution, it is then sufficient to construct the installation with an air reserve volume equal to the largest of the two volumes found then, during use, to reduce the volume of this reserve depending on the value of the load.

This adaptation of the volume of the air reserve of the accumulators to the load may be achieved either by steps by placing certain air cylinders out of service, or continuously by ballasting or even by combining these two processes.

It should be noted that the volume of the air reserve of the accumulators depends on the load Q through the ratio U/Q.

Therefore, if, despite the variation of Q, the ratio U/Q remains constant, the air reserve itself remains constant. This forms a second solution.

Depending on the value selected for $Q_{exact}$, the value of the air reserve will be such that:

$$\frac{V_a}{S_v \cdot C_{cdc}} = K = \frac{1}{1 - \left[\frac{B_m + U_{const}/Q_{exact}}{A_m + B_m + U_{const}/Q_{const}}\right]^{-\frac{1}{\gamma}}} \tag{35}$$

Since the weight $U_{const}$ of the moving parts does not contribute to the tension of the cables, it will have to be artificially modified, for example by the action of an auxiliary correction cylinder or jack 49 which provides the force $U_v$, so that we always have:

$$\frac{U_{const} - U_v}{Q} = \frac{U_{const}}{Q_{const}} \tag{36}$$

That is:

$$U_v = U_{const}\left(1 - \frac{Q}{Q_{exact}}\right) \tag{37}$$

The correcting cylinder or jack 49 is preferably a single acting cylinder. In such case it will be advantageous to chose $Q_{MAX}$ for the value of $Q_{exact}$. Otherwise, it will be advantageous to fix $Q_{exact}$ somewhere between $Q_{MAX}$ and $Q_{min}$ depending on the hydraulic considerations.

However, if it is desirable for the value $U_v$, already independent of the stroke, to be independent of the load as well, $Q_{exact}$ could be chosen infinitely great, i.e. as long as possible in which case we would then have $U_v = U_{const}$.

Physically, and only considering the static phenomena, that means that the mobile assembly supporting the crown block is balanced, for example, as if by counter weights.

Finally, the operating pressure when the stroke is zero remains determined by the formula:

$$P_M = Q \frac{B_m + U_{const}/Q_{exact}}{S_v}$$

It is possible to combine these two solutions. Let us suppose that the interesting solution has been chosen where $Q_{exact} = Q_{MAX}$.

The correction cylinder must be able to develop the maximum force:

$$U_{v\,MAX} = U_{const}\left[1 - \frac{Q_{min}}{Q_{MAX}}\right] \tag{38}$$

In fact, with a particular value of Q between $Q_{MAX}$ and $Q_{min}$ which will be called $Q_{inter}$, the operating interval defined by $Q_{MAX}$ and $Q_{min}$ can be split into two complementary intervals. The first will be defined by $Q_{MAX}$ AND $Q_{inter}$, whereas the second will be defined by $Q_{inter}$ and $Q_{min}$.

The volume of the air reserves of the accumulators is, for the first interval, such that:

$$\frac{V_{a1}}{S_v \cdot C_{cdc}} = K_1 = \frac{1}{1 - \left[\frac{B_m + U_{const}/Q_{MAX}}{A_m + B_m + U_{const}/Q_{MAX}}\right]^{-\frac{1}{\gamma}}} \tag{39}$$

And for the second such that:

$$\frac{V_{a2}}{S_v \cdot C_{cdc}} = K_2 = \frac{1}{1 - \left[\frac{B_m + U_{const}/Q_{inter}}{A_m + B_m + U_{const}/Q_{inter}}\right]^{-\frac{1}{\gamma}}} \tag{40}$$

The ratio U/Q is kept constant, by the action of the correcting cylinder which provides the force $U_v$, so that in the first interval we have:

$$\frac{U_{const}}{Q_{MAX}} = \frac{U_{const} - U_v}{Q} = \frac{U_{const} - U'_{MAX}}{Q_{inter}} \quad (41)$$

and in the second:

$$\frac{U_{const}}{Q_{inter}} = \frac{U_{const} - U_v}{Q} = \frac{U_{const} - U'_{MAX}}{Q_{min}} \quad (42)$$

The ratio of these expressions determines $Q_{inter}$, for it gives:

$$Q^2_{inter} = Q_{MAX} \cdot Q_{min}$$

and so:

$$U'_{vMAX} = U_{const}\left[1 - \frac{Q_{min}}{Q_{MAX}}\right] \quad (43)$$

We had established that, over the whole of the interval $Q_{MAX}$–$Q_{min}$ and for this favorable case where $Q_{exact}$=$Q_{MAX}$, we had:

$$U_{vMAX} = U_{const}\left[1 - \frac{Q_{min}}{Q_{MAX}}\right] \quad (44)$$

All other things being equal, with large sized apparatus 20% can be gained on the maximum performances of this correcting cylinder 49.

This is only one example, and it is an economic survey which will show whether there is an advantage in creating several operating ranges which will preferably overlap.

Up to now, operating modes only have been considered where the response of the mechanical and hydraulic systems are parallel.

In the case where the volume of the air reserve is matched to the load handled, an adjustment parameter remained which was used for superimposing the responses which were parallel.

In that in which the volume of the air reserve is fixed once and for all, the parallel response curves have been superimposed through the action of a second system, called correction system, which must supply a force adapted to the load handled, but constant over the whole compensation stroke. It is moreover from this point of view that this mode of operation is advantageous, for this correction, independent of the stroke and so constant for a given load, may be possibly ensure by a passive system, i.e. which does not permanently require energy from the outside.

This mode of operation may also be considered as a mode of operation with error in the case where the correction system is not installed. The error is then equal to the force which was required of the correction system.

But, it is also possible in this mode of operation where the air reserve is constant, to abandon the principle of parallelism of the response, in favor of equality thereof at any point of the compensation stroke.

If it is contemplated not to correct the value of the stroke, for which the equality of the mechanical and hydro-pneumatic responses is provided, it will be chosen so that the greatest difference between the responses, that is to say the error, is minimum.

If we consider the linearized responses, it is obvious that it is in mid stroke that this condition is achieved.

This is acquired when the error is, except for the sign, the same at each of the terminals and, if we consider the linearized response, this occurs when it is in mid stroke that the equality of mechanical and hydro-pneumatic response is achieved.

I claim:

1. A device for fastening an element to a mobile installation subject to vertical movements, the device serving to minimize effects on said element due to vertical movements of said mobile installation, the device comprising:

a first block and a second block vertically disposed with respect to each other and to said mobile installation, said second block being fastened to said element and said first block being connected to a moving end of an actuating piston and cylinder unit having a second end secured to said mobile installation, said first block being connected to first and second rods on opposite sides of a vertical axis connected between the axes of said first and second blocks;

first and second fixed pulleys having respective shafts which are fixed with respect to said mobile installation, said shafts of said first and second fixed pulleys being connected to third and fourth rods on opposite sides of said vertical axis so as to enable said third and fourth rods to be respectively pivotable on the shafts of said first and second fixed pulleys;

a first intermediate pulley having a shaft connected to said first rod for movement relative to said first block and for arcuate movement relative to the shaft of said first fixed pulley;

a second intermediate pulley having a shaft connected to said second rod for movement relative to said first block and for arcuate movement relative to the shaft of said second fixed pulley;

first and second cable retaining members secured to said mobile installation on opposite sides of said vertical axis;

a cable extending between said cable retaining members on said mobile installation while passing successively from said first retaining member on the first fixed pulley, on a side nearest the vertical axis, to the first intermediate pulley, on a side remote from the vertical axis, and then to said first block, to said second block and back to said first block to form at least one loop, then over the second intermediate pulley, on a side remote from said vertical axis, the second fixed pulley, on a side nearest the vertical axis, and to the second retaining member on said mobile installation; and a fluid accumulator connected to supply a fluid under pressure to the actuating piston and cylinder unit.

2. The device as defined in claim 1, wherein an angle formed by a straight line joining an axis of the first fixed pulley and an axis of the first intermediate pulley and a straight line formed by the cable between the first fixed pulley and the first intermediate pulley and an angle formed by a straight line joining an axis of the second fixed pulley and an axis of the second intermediate pulley and a straight line formed by the cable between the second fixed pulley and the second intermediate pulley are each at least 30°.

3. The device as defined in claim 1, wherein said piston and cylinder unit comprises a plurality of cylinders each with a separate piston connected to the same fluid pressure supply and with all of said pistons being movable in the same direction which is substantially parallel to said vertical axis.

4. The device as claimed in claim 1, further comprising an auxiliary correction cylinder and piston unit movable along a direction parallel to said vertical axis which provides a force in a direction to offset the weight of said element.

5. The device as defined in claim 4, further comprising means for detecting vertical displacement of said second block and means responsive to an output signal from said detecting means to supply a correcting pressure to said auxiliary correction cylinder tending to maintain said second block at a fixed elevation along said vertical axis.

6. The device as defined in claim 4, wherein said mobile installation is a floating derrick which suspends an element toward a sea floor and further comprising means for detecting a change in position between said element and the sea floor, means for generating a control signal in response to changes in said distance between the element and the sea floor, and means responsive to said control signal for adjusting the hydraulic pressure applied to said correction cylinder to maintain said element at a substantially constant distance from the sea floor.

7. The device as claimed in claim 1, wherein said cylinder of said actuating piston and cylinder unit is disposed parallel to a movement direction of the first block, and all mechanical forces contributing to a tension of the cable exerted on the first block due to movements of the installation and a hydro-pneumatic force of the fluid accumulator are determined in accordance with the following relationships:

$$F_m = Q + \frac{Q}{N}\left[\sin\beta \frac{\text{sine}\ \theta}{\text{sine}\ (\theta-\phi)} + \text{sine}(\theta+\gamma) - \text{sine}\ \theta \frac{\text{sine}\ (\theta+\gamma-\phi)}{\text{sine}\ (\theta-\phi)}\right] + U$$

and $$F_v = P_g S_v \left[1 - \frac{1}{K}\ (1 - R_{educed\ stroke})\right]^{-\gamma}$$

wherein:

$F_m$=all of the mechanical forces exerted on the first block, $F_v$=the hydro-pneumatic force of the fluid accumulator, Q=force coming from all that contributes to the tension of the cable, N=number of strands of the second block U=fraction of $F_m$ independent of the tension of the cable, β=angle formed by the strand of the cable between the fixed pulley and the intermediate pulley and the straight line joining the centers of these two pulleys, ϕ=angle defined by the direction of the straight line joining the center of the first and second fixed pulleys and the direction of the straight line joining the axes of the first fixed pulley and of the first intermediate pulley, γ=angle formed by the cable strand joining the intermediate pulley and the pulley of the block and a straight line joining the centers of these two pulleys, Θ=angle formed by the direction of the straight line joining the center of the first and second fixed pulleys and the direction of the straight line joining the centers of the first block and of the first intermediate pulley;

$P_g$=preinflation pressure of the fluid accumulators, $S_v$=a cross-section of the actuating piston and cylinder unit, $K=V_a/S_vC_{cdc}$, with:

$V_a$=a volume of the accumulators, $C_{cdc}$=a total stroke of the first block, $R_{educed}$ stroke=actual stroke/$C_{cdc}$ γ=an expansion coefficient of gases contained in the accumulator and tube containing the hydro-pneumatic fluid.

8. The device as claimed in claim 7, wherein the half the distance separating the axes of the first and second pulleys, the length of the first, second, third and fourth rods, and the path of the cable are determined so as to provide an identical linear expression of the mechanical force $F_m$ and the hydro-pneumatic force $F_v$.

9. The device as claimed in claim 8, wherein the relationship for determining the hydro-pneumatic force is linearized by only considering the hydro-pneumatic forces determined by said relationship at the two endmost points of the movement of the first block.

10. A device for insulating an element fastened to a mobile installation subject to movement from effects on the element due to the movements of the installation, the device comprising:

a first block;

a second block for fastening said element to the mobile installation;

a first intermediate pulley;

a second intermediate pulley;

first rod means for connecting said first block to said first intermediate pulley;

second rod means for connecting said first block to said second intermediate pulley;

a first pulley fixed with respect to the mobile installation;

a second pulley fixed with respect to the mobile installation;

third rod means pivotally connected to a shaft of said first pulley and to a shaft of the first intermediate pulley;

fourth rod means pivotally connected to a shaft of said second pulley and to a shaft of the second intermediate pulley;

first cable retaining means provided on said mobile installation;

second cable retaining means provided on said mobile installation;

cable means for connecting said first and second retaining means together, said cable means passing successively from the second retaining means over the first pulley, the first intermediate pulley, the first block and the second block and back to said first block to form at least one cable loop, then over the second intermediate pulley and the second fixed pulley;

at least one actuating unit having a first end connected to the first block and a second end connected to the mobile installation, said actuating unit including a cylinder and an actuating piston, said actuating piston having a displacement stroke relative to said piston;

at least one accumulator means hydro-pneumatically connected to said at least one actuating unit for supplying a pressurized fluid to said cylinder;

wherein the first rod means and the second rod means each have an identical length, the third rod means and the fourth rod means each have an identical length, and wherein a half of a distance separating a rotational axis of the first pulley and the second pulley, a distance separating the axis of the first block from the plane joining the axes of the first and second pulleys, a length of the first and second rods means, and the path of the cable means are determined so that all mechanical forces contributing to a tension in the cable means exerted on the first block due to the movements of the installation and a hydro-pneumatic force of the accumulator means are substantially equal over at least a portion of the displacement stroke of the piston of the at least one actuating unit.

11. The device as claimed in claim 10, further comprising an auxiliary correction cylinder means connected to said first block for enabling a correction of an inequality of the mechanical forces and hydro-pneumatic force, and means for adjusting a force of the auxiliary correction cylinder means.

12. The device as claimed in claim 11, further comprising measuring means for measuring a force exerted by the second block on said first block, and means for driving the auxiliary correction cylinder means.

13. The device as claimed in claim 10, wherein an angle formed by a straight line joining an axis of the first fixed pulley and an axis of the first intermediate pulley and a straight line formed by the cable between the first fixed pulley and the first intermediate pulley and an angle formed by a straight line joining an axis of the second fixed pulley and an axis of the second intermediate pulley and a straight line formed by the cable between the second fixed pulley and the second intermediate pulley are each at least 30°.

14. The device as claimed in claim 13, wherein said angle is at least equal to 45°.

15. The device as claimed on one of claims 10 or 11, wherein the first block comprises a ballasting means.

16. The device as claimed in claim 10, wherein said cylinder of said actuating unit is disposed in parallel to a movement direction of the first block resulting from movements of the installation, wherein all mechanical forces exerted on the first block and the hydro-pneumatic force of the fluid accumulator are respectively determined in accordance with the following relationships:

$$F_m = Q + \frac{Q}{N}\left[\sin\beta \frac{\text{sine}\,\theta}{\text{sine}\,(\theta-\phi)} + \text{sine}(\theta+\gamma) - \text{sine}\,\theta \frac{\text{sine}\,(\theta+\gamma-\phi)}{\text{sine}\,(\theta-\phi)}\right] + U$$

and $$F_v = P_g S_v \left[1 - \frac{1}{K}\,(1 - R_{educed\ stroke})\right]^{-\gamma}$$

in which:

$F_m$=all of the mechanical forces exerted on the first block, $F_v$=hydro-pneumatic force of the fluid accumulator, Q=force coming from all that contributes to the tension of the cable means, N=number of strands of the second block, U=fraction of $F_m$ independent of the tension of the cable means, β=angle formed by the strand of the cable means between the fixed pulley and the intermediate pulley and the straight line joining the centers of these two pulleys, ϕ=angle defined by the direction of the straight line joining the center of the first and second fixed pulleys and the direction of the straight line joining the axes of the first fixed pulley and of the first intermediate pulley, γ=angle formed by the strand of the cable means Joining the intermediate pulley and the pulley of the block and a straight line joining the centers of these two pulleys, Θ=angle formed by the direction of the straight line joining the center of the first and second fixed pulleys and the direction of the straight line joining the centers of the first block and of the first intermediate pulley;

$P_g$=preinflation pressure of the at least one accumulator means, $S_v$=a cross-section of the actuating cylinder-piston unit, $K=V_a/S_vC_{cdc}$ with $V_a$=a volume of the at least one accumulator means, $C_{cdc}$=a total stroke of the first block, $R_{educed}$ stroke=actual stroke/$C_{cdc}$ γ'=an expansion coefficient of gases contained in the at least one accumulator means and tube containing the pressurized fluid.

17. The device as claimed in claim 16, wherein half of the distances separating the axes of the first and second pulleys, the length of the first, second, third and fourth rod means, and the path of the cable are determined so as to provide an identical linear expression of the mechanical forces and the hydro-pneumatic force.

18. The device as claimed in claim 16, wherein the relationship for determining the hydro-pneumatic forces is linearized by only considering the hydro-pneumatic force determined by the relationship at the two end most points of a movement stroke of the first block.

19. A method for determining a geometry of a device for insulating an element fastened to a mobile installation subject to movement from effects on the element due to the movements of the installation, the method comprising the steps of:

providing a first and a second block, fastening said element to said second block, respectively connecting said first block to a shaft of a first intermediate pulley and a shaft of a second intermediate pulley by a first and second rod of equal length, fixing a first pulley and a second pulley with respect to the mobile installation, respectively connecting a shaft of the first fixed pulley and a shaft of the second fixed pulley to the shaft of the first and second intermediate pulleys by a third and fourth rod of equal length, providing a first and a second cable retaining member, connecting said first and second cable retaining members together by successively passing a cable from the second retaining member, over the first fixed pulley, the first intermediate pulley, the first block and the second block while forming at least one cable loop, then passing the cable over the second intermediate pulley and the second fixed pulley, providing at least one actuating cylinder-piston unit, connecting a first end of said at least one actuating cylinder-piston unit to the first block, connecting a second end of the at least one actuating cylinder to the mobile installation, providing at least one accumulator connected in a hydro-pneumatic relationship with said actuating cylinder-piston unit, determining magnitudes of a length of the first, second, third and fourth rods, a half of the distance separating the rotational axis of the first and second fixed pulleys, a distance separating the axis of the first block from a plane joining the axes of the first and second pulleys, and a path of the cable so that all mechanical forces contributing to a tension in the cable exerted on the first block to movements of the installation and the hydro-pneumatic force are substantially equal over at least a portion of a stroke of the at least one actuating cylinder-piston unit.

20. The method as claimed in claim 19, wherein the magnitudes of the distances separating the axes of the first and second pulleys, the length of the first, second, third and fourth rods, and the path of the cable are determined so that linearized expressions of the mechanical forces and the hydro-pneumatic force are parallel.

21. The method as claimed in claim 19, wherein the magnitudes of the distance separating the axis of the first and second pulleys, the length of the first, second, third and fourth rods, and the path of the cable are determined so that linearized expressions of the mechanical forces and hydro-pneumatic force have at least one common point.

* * * * *